United States Patent [19]

Iwata

[11] Patent Number: 4,700,674

[45] Date of Patent: Oct. 20, 1987

[54] INTAKE AIR QUANTITY CONTROL METHOD FOR INTERNAL COMBUSTION ENGINES AT DECELERATION

[75] Inventor: Takahiro Iwata, Asaka, Japan

[73] Assignee: Honda Giken Kogyo K.K., Tokyo, Japan

[21] Appl. No.: 810,851

[22] Filed: Dec. 18, 1985

[30] Foreign Application Priority Data

Dec. 20, 1984 [JP] Japan ..... 59-267508

[51] Int. Cl.[4] ..... F02M 23/06; F02M 23/08

[52] U.S. Cl. ..... 123/327; 123/339; 123/585

[58] Field of Search ..... 123/339, 585, 586, 587, 123/327

[56] References Cited

U.S. PATENT DOCUMENTS

| | | | |
|---|---|---|---|
| 4,406,262 | 9/1983 | Ikeura | 123/339 |
| 4,418,665 | 12/1983 | Nagase | 123/339 |
| 4,438,744 | 3/1984 | Hasegawa | 123/327 |
| 4,491,107 | 1/1985 | Hasegawa et al. | 123/339 |
| 4,557,234 | 12/1985 | Ito | 123/585 X |

FOREIGN PATENT DOCUMENTS

| | | |
|---|---|---|
| 0098628 | 7/1980 | Japan . |
| 0098629 | 7/1980 | Japan . |

*Primary Examiner*—Willis R. Wolfe, Jr.
*Attorney, Agent, or Firm*—Arthur L. Lessler

[57] ABSTRACT

A method for controlling the valve opening period of a control valve for controlling a quantity of supplementary air supplied to an internal combustion engine during idling in a feedback manner responsive to the difference between the actual engine speed value and a desired idling speed value. When the engine is decelerating with the throttle valve fully closed, it is determined which of a plurality of predetermined engine speed values higher than the desired idling speed value, the engine speed has dropped across, and a decrease rate of the engine speed is detected at one of the predetermined engine speed. A quantity of supplementary air is determined, which corresponds to the one detected predetermined engine speed value and the detected decrease rate, based upon which the control valve is opened. Preferably, the determined valve opening period is corrected depending upon a magnitude of load of an electrical device applied on the engine.

6 Claims, 8 Drawing Figures

FUEL INJECTION VALVE
INTERNAL COMBUSTION ENGINE
Ne
INPUT CIRCUIT
CPU
STORAGE MEANS
OUTPUT CIRCUIT
ECU
PBA
θTH
1
2
3
4
5
6
6a
6b
7
8
8a
9
9a
9b
9c
9d
10
11
12
13
14
15
15a
16
16a
17
17a
18
18a
19

ENGINE RPM
(A)
NA
NSA1
NSA2
NSA3
NH
NL
t1
t2
t3
t4
t5
t6
t7
t8
t9
t11
t12
t13
t14
a
b
c
TIME
VALVE OPENING DUTY RATIO
(B)
DOUT
DSA
TSA
TSA
DXREF+DE
O
t'2
t'7
t'10
TIME

FIG.5
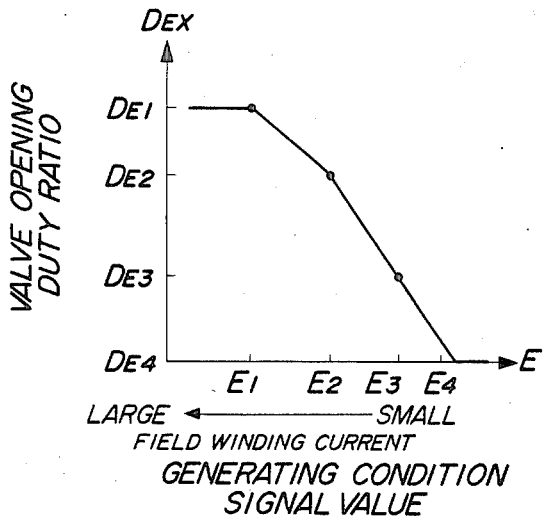
FIG.6
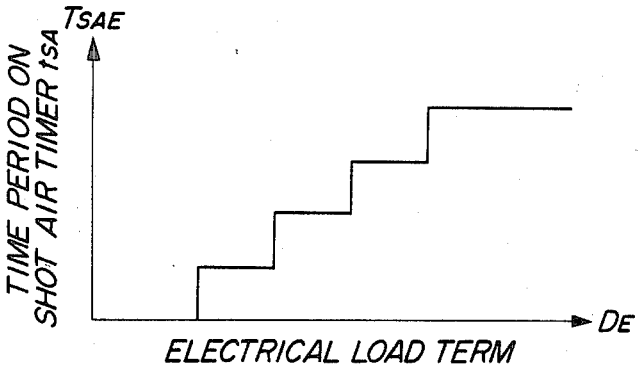
FIG.7
| | MSA1 | MSA2 | MSA3 |
|---|---|---|---|
| ΔMe3 | TSA1,3 | TSA2,3 | TSA3,3 |
| ΔMe2 | TSA1,2 | TSA2,2 | TSA3,2 |
| ΔMe1 | TSA1,1 | TSA2,1 | TSA3,1 |
| ΔMe0 | TSA1,0 | TSA2,0 | TSA3,0 |

INTAKE AIR QUANTITY CONTROL METHOD FOR INTERNAL COMBUSTION ENGINES AT DECELERATION

BACKGROUND OF THE INVENTION

This invention relates to an idling speed feedback control method for internal combustion engines, and more particularly to a method of this kind which can prevent engine stall at transition of the engine operation from a decelerating condition with the throttle valve fully closed to the idling speed feedback controlling condition.

An internal combustion engine in general can easily stall due to a drop in the engine speed when the engine is operated in an idling condition while engine coolant temperature is low or when the engine is heavily loaded with electrical loads by head lamps, electric blower, air-conditioner, etc. in a vehicle equipped with the engine. To eliminate such disadvantage, an idling speed feedback control method has been proposed e.g. by Japanese Provisional Patent Publication (Kokai) No. 55-98628, which comprises setting a desired idling speed in dependence upon load on the engine, detecting the difference between the actual engine speed and the desired idling speed, and supplying supplementary air to the engine in a quantity corresponding to the detected difference so as to minimize the same difference, to thereby control the engine speed to the desired idling speed.

According to this proposed method, if the above idling speed feedback control is carried out when the engine is decelerating toward the idling region with the throttle valve fully closed, the engine speed can abruptly decreases, depending upon the engine temperature and electrical load such as the air-conditioner. Then, even if idling speed feedback control, hereinafter referred to, is started immediately following the abrupt decrease in engine speed, it cannot immediately follow the abrupt speed decrease to supply a required quantity of supplementary air to the engine, often resulting in engine stall.

To avoid this disadvantage, an idling speed feedback control method has been proposed e.g. by Japanese Provisional Patent Publication (Kokai) No. 55-98629. According to this proposed method, in transition from a decelerating condition to an idling speed feedback controlling condition, the quantity of supplementary air is controlled in decelerating mode wherein the quantity of supplementary air required for maintaining the engine speed at the desired idling speed is estimated in advance of the completion of the transition of the engine operation and the estimated quantity of supplementary air is previously supplied to the engine before the idling speed feedback control is started, to thereby ensure smooth transition to the idling operation.

However, even if the above decelerating mode control of supplementary air quantity is carried out in advance of the completion of the transition of the engine operation to the idling speed feedback controlling condition, for instance, when the clutch is disengaged to disconnect the engine and the driving wheels, or when the engine is racing, the engine speed can suddenly drop far below the desired idling speed (i.e. engine speed overshoot), resulting in a delay in controlling the engine speed to the desired idling speed, even if supplementary air has been previously supplied by the above proposed method before the feedback control starts.

In order to avoid this disadvantage, the quantity of supplementary air previously supplied before the start of feedback control is increased by a predetermined quantity, then, the engine speed will not promptly reach the idling speed at slow deceleration of the engine (i.e. the engine speed undershoots). Thus this method also cannot solve the problem of delay in controlling the engine speed to the desired idling speed.

SUMMARY OF THE INVENTION

The present invention has been made to eliminate delay in the start of feedback control which is inherent to the above conventional idling speed feedback control methods.

It is an object of the invention to prevent engine stall even when the engine speed suddenly drops, during deceleration of the engine toward the idling speed feedback control region.

It is another object of the present invention to ensure preventing engine stall even with a great electrical load on the engine, during deceleration of the engine toward the idling speed feedback control region.

According to the present invention, an idling speed feedback control method is provided for an internal combustion engine having an intake passage, a throttle valve arranged in said intake passage, a supplementary air passage bypassing the throttle valve in the intake passage, and a control valve arranged in the supplementary air passage for controlling a quantity of supplementary air to be supplied to the engine, wherein the rotational speed of the engine is detected during idling operation of the engine, and the control valve has a valve opening period thereof controlled in a feedback manner responsive to a difference between the detected engine speed and a desired idling speed value, the method comprising the steps of: (a) setting a plurality of predetermined engine speed values higher than the desired idling speed value; (b) determining which of the plurality of predetermined engine speed values the engine speed has dropped across, when the engine is decelerating toward the desired idling speed value; (c) detecting a decrease rate of the engine speed at one of the predetermined engine speed values across which the engine speed is determined to have dropped; (d) determining a quantity of supplementary air supplied from the control valve corresponding to the one of the predetermined engine speed values determined at step (b) and the decrease rate detected at step (c); and (e) driving the control valve to open based upon the quantity of supplementary air determined at step (d).

Preferably, the aforementioned quantity of supplementary air supplied from the control valve is set to a smaller value as the one of the predetermined engine speed values detected at step (c) is closer to the desired idling speed value.

Also preferably, the quantity of supplementary air supplied from the control valve is set to a larger value as the decrease rate of the engine speed detected at step (d) is larger.

Further preferably, the control valve is opened only when the decrease rate of the engine speed detected at step (d) is larger than a predetermined value.

According to a preferred embodiment of the invention, a method is provided for an internal combustion engine having an intake passage, a throttle valve arranged in the intake passage, a supplementary air passage bypassing the throttle valve in the intake passage, a control valve arranged in the supplementary air passage for controlling a quantity of supplementary air to be supplied to the engine, and at least one electrical device driven by the engine, wherein rotational speed of the engine is detected during idling operation of the engine, and the control valve has a valve opening period thereof controlled in a feedback manner responsive to a difference between the detected engine speed value and a desired idling speed value, the method comprising the steps of: (a) setting a plurality of predetermined engine speed values higher than the desired idling speed value; (b) detecting a magnitude of load applied on the engine by the electrical device, when the engine is decelerating toward the desired idling rpm; (c) determining which of the plurality of predetermined engine speed values the engine speed has dropped across, when the engine is decelerating toward the desired idling speed value; (d) detecting a decrease rate of the engine speed at one of the predetermined engine speed values across which the engine rpm is determined to have dropped; (e) determining a quantity of supplementary air supplied from the control valve corresponding to the one of the predetermined engine speed values determined at step (c) and the decrease rate detected at step (d); (f) correcting the quantity of supplementary air determined at step (e) in dependence on the magnitude of load of the electrical device detected at step (b); and (g) driving the control valve to open based upon the quantity of supplementary air determined at step (d).

Preferably, the engine includes a generator device driven by the engine for supplying electric power to the electrical device, the magnitude of load applied by the electrical device on the engine being detected based upon the detected engine speed and a value of a parameter indicative of generating conditions of the generator device.

The above and other objects, features and advantages of the invention will be more apparent from the ensuing detailed description taken in conjunction with the accompanying drawings.

BRIEF DESCRIPTION OF THE DRAWINGS

FIG. 5 is a graph illustrating the relationship between a generating condition signal value E and a valve opening duty ratio Dx;

FIG. 6 is a graph illustrating the relationship between a electrical load term DE and a setting time period TSAE of a shot air timer; and FIG. 7 is a graph illustrating a map for setting a time period TSAM of the shot air timer.

DETAILED DESCRIPTION

The method of the invention will be described in detail with reference to the drawings.

Figure 1:
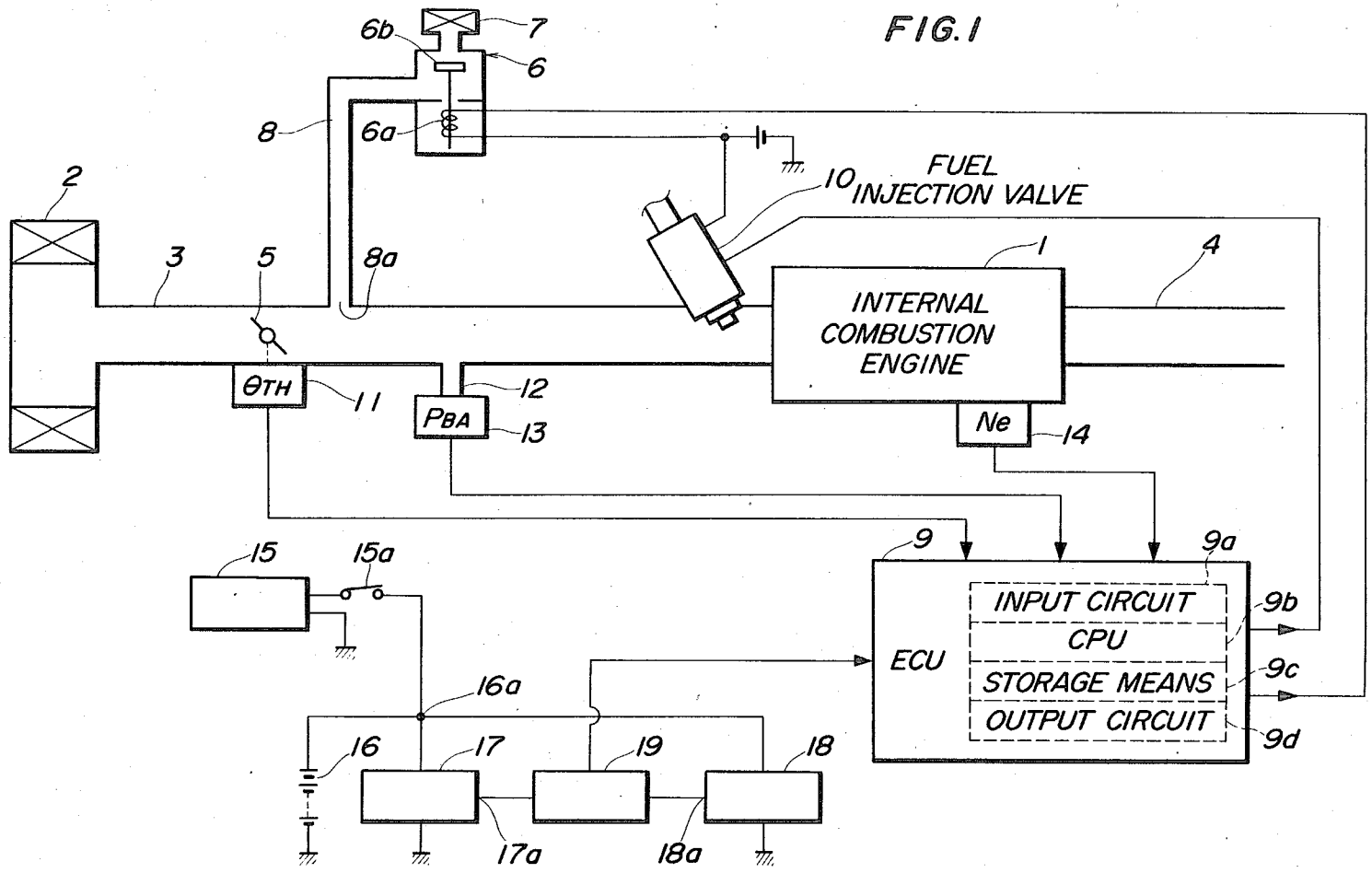
FIG. 1 is a block diagram illustrating the whole arrangement of an idling speed feedback control system to which is applied the method of the invention.

Referring first to FIG. 1, an idling speed feedback control system is schematically illustrated, to which is applicable the method of the invention. In FIG. 1, reference numeral 1 designates an internal combustion engine which may be a four-cylinder type for instance, and to which are connected an intake pipe 3 with an air cleaner 2 mounted at its open end, and an exhaust pipe 4, at an intake side and an exhaust side of the engine 1, respectively. A throttle valve 5 is arranged within the intake pipe 3, and an air passage 8 opens at its one end 8*a* into the intake pipe 3 at a location downstream of the throttle valve 5. The air passage 8 has its other end communicating with the atmosphere and provided with an air cleaner 7. A supplementary air quantity control valve (hereinafter called merely "the control valve") 6 is arranged across the air passage 8 to control the quantity of supplementary air being supplied to the engine 1 through the air passage 8. This control valve 6 is a normally closed type solenoid valve and comprises a solenoid 6*a* and a valve body 6*b* disposed to open the air passage 8 when the solenoid 6*a* is energized. The solenoid 6*a* is electrically connected to an electronic control unit (hereinafter called "the ECU") 9. Fuel injection valves 10 are arranged in a manner projected into the intake pipe 3 at locations between the engine 1 and the open end 8*a* of the air passage 8, and are connected to a fuel pump, not shown, and also electrically connected to the ECU 9.

A throttle valve opening ($\theta$th) sensor 11 is connected to the throttle valve 5, and an absolute pressure sensor (PBA) 13 is provided in communication with the intake pipe 3 through a conduit 12 at a location downstream of the open end 8*a* of the air passage 8, while an engine rotational angle position (Ne) sensor 14 is mounted on the body of the engine 1. All the sensors are electrically connected to the ECU 9. The Ne sensor 14 succesively generates a crank angle signal (hereinafter called "the TDC signal") at a crank angle position before a predetermined crank angle with respect to the top dead center (TDC) at the start of suction stroke of each cylinder and supplies the TDC signal to the ECU 9.

Reference numeral 15 designates electrical devices such as head lamps, a driven radiator fan, a heater fan, one ends of which are electrically connected to a junction 16*a* by way of respective switches 15*a*, while the other ends are grounded. Between the junction 16*a* and ground, there are arranged in parallel a battery 16, an A.C. generator 17, and a regulator 18 disposed to supply field winding current to the generator 17 in response to the load on the electrical devices 15. A field winding current output terminal 18*a* of the regulator 18 is connected to a field winding current input terminal 17*a* of the generator 17 through a generating condition sensor 19. The generating condition sensor 19 supplies the ECU 9 with a signal representative of generating conditions of the generator 17 (e.g. a signal E having a voltage level corresponding to field winding current supplied from the regulator 18 to the generator 17).

The generator 17 is mechanically connected to an output shaft, not shown, of the engine 1 to be driven thereby and supplies the electrical devices 15 with electric power when the respective switches 15*a* are closed (ON). When the power required to drive the electrical devices 15 exceeds the generating capacity of the generator 17, the battery 16 in turn supplies electric power compensating to the shortage. The ECU is supplied with engine operating condition parameter signals respectively from the throttle valve opening sensor 11, the absolute pressure sensor 13, and the Ne sensor 14 and a generating condition signal from the generating condition sensor 19. The ECU 9 comprises an input circuit 9*a* having functions such as waveform shaping and voltage level shifting for input signals and converting analog signals into degital signals, a central processing unit 9*b* (hereinafter called "the CPU"), a storage means 9*c* for storing calculation programs executed by the CPU 9*b* and calculation results, and an output circuit 9*d* for supplying driving signals to the fuel injection valves 10 and the control valve 6. The ECU 9 detects engine operating conditions and engine load conditions such as electrical loads based upon engine condition parameter signal values and a generating condition signal value, and sets a desired idling speed value to be applied during idling operation the engine in response to these detected conditions. Also the ECU 9 calculates fuel quantity to be supplied to the engine 1 (i.e. valve opening period of the fuel injection valves 10) and supplementary air quantity (i.e. valve opening duty ratio DOUT of the control valve 6) respectively to supply the fuel injection valves 10 and the control valve 6 with driving signals in response to respective calculation results.

The solenoid 6*a* of the control valve 6 is energized to open the valve body 6*b* for a valve opening period corresponding to the valve opening duty ratio calculated by the ECU 9 so that a desired quantity of supplementary air corresponding to the valve opening period is supplied to the engine 1 through the air passage 8 and intake passage 3.

If the quantity of supplementary air is increased by setting the valve opening period of the control valve 6 at a larger value, an increased quantity of mixture is supplied to the engine 1, to increase the engine output, and accordingly increase the engine speed. On the other hand, if the valve opening period is set at a smaller value, a decreased mixture quantity is supplied to the engine to thereby decrease the engine speed. In this way, the engine speed is controlled by controlling the quantity of supplementary air, that is, the valve opening period of the control valve 6 during idling of the engine.

The fuel injection valves 10 are each opened during a valve opening period calculated by the ECU 9 to thereby supply the engine 1 with a required quantity of fuel.

Figure 2:
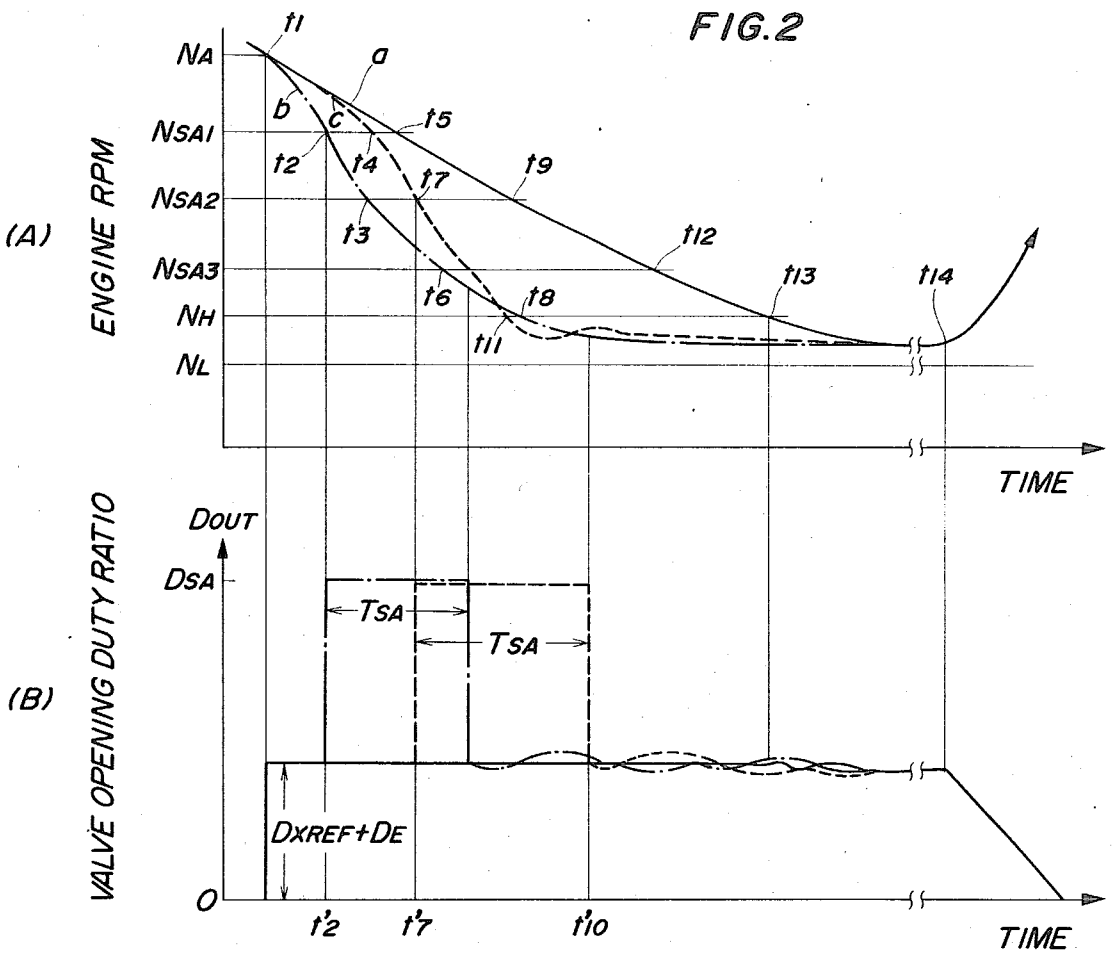
FIGS. 2A and 2B are a timing chart useful in explaining the idling speed feedback control method according to the invention, showing a manner of change in the engine speed Ne and the valve opening duty ratio DOUT of a supplementary air quantity control valve with respect to the lapse of time.

The method of the present invention will now be described with reference to FIG. 2 showing a manner of change in the engine speed Ne and the valve opening duty ratio DOUT of the supplementary air quantity control valve 6 with respect to the lapse of time.

According to the invention, first, second and third predetermined values NSA1, NSA2, NSA3 are provided and set at values intermediate between a predetermined speed value NA and the upper limit NH of the desired idling speed value. When the engine speed drops across each of the predetermined values NAS1, NSA2, and NSA3, the difference between the actual engine speed and the each predetermined speed values detected before and after the actual engine speed drops across the each predetermined speed values, that is, the decrease rate ΔNe is detected. When this decrease rate ΔNe is larger than a predetermined value NSA, the valve opening duty ratio DOUT of the control valve 6 is set to and held at a predetermined value DSA (e.g. 100%, or may be 80% depending upon opening area of the control valve 6) over a period of time equal to the sum of a time period determined by the traversed predetermined speed value and the decrease rate ΔNe and a time period determined by load applied by the electrical devices 15, to thereby supply supplementary air to the engine 1 (hereinafter called "the air shot control").

To be more specific, when the engine is in decelerating condition toward the desired idling speed with the throttle valve fully closed and the engine speed Ne is below the predetermined speed value NA (at a time t1 in FIG. 2), the valve opening duty ratio DOUT of the control valve 6 is set to an initial value DXREF+DE applied at the start of feedback control (time period t13–t14 when the engine decelerates along a solid line a in FIG. 2, time period t8–t14 when the engine decelerates along a one dot chain line b, and time period t11–t14 when the engine decelerates along a dashed line c,) (in (B) of FIG. 2). When the engine slowly decelerates along the solid line a in FIG. 2, each time the engine speed Ne drops across the first, second or third predetermined value NSA1, NSA2, NSA3, at time (t5), (t9) or (t12), the decrease rate ΔNe is obtained. Since the decrease rate ΔNe shows a value smaller than the predetermined value ΔNSA when the engine decelerates along the solid line a, the engine 1 is then determined to be in slow decelerating state at any of the predetermined speed values, and accordingly supplementary air is continually supplied to the engine with a valve opening duty ratio equal to the set initial value DXREP+DE from the time (t1) the engine speed drops below the predetermined speed value NA to the time (t13) the engine speed reaches the upper limit NH of the desired idling speed at which feedback control starts (called "the deceleration mode control"). By thus supplying the engine with a quantity of supplementary air determined in decelerating mode from the time the engine speed Ne drops below the predetermined speed value NA to the time the engine speed reaches the upper limit NH of the desired idling speed whereat control is started in feedback mode, hereinafter referred to, a transition to the feedback mode control can be smoothly effected without the engine speed dropping far below the desired idling speed.

From the time (t13) the engine speed drops below the upper limit NH of the desired idling speed, the valve opening duty ratio DOUT of the control valve 6 is controlled in a feedback manner responsive to the difference between the desired idling speed and the actual engine speed so as to keep the engine speed at a value between the upper limit NH and a lower limit NL smaller by a predetermined value than the upper limit NH.

When a transition occurs in the engine operation from idling state to accelerating state by opening the throttle valve 5 (after a time t14 in (A) of FIG. 2), the valve opening duty ratio DOUT is gradually decreased from an initial value set immediately before the throttle valve 5 is opened, to zero (after the time t14 in (B) of FIG. 2; hereinafter called "the accelerating mode control"). By thus gradually decreasing the quantity of supplementary air as stated above, the transition of the engine operation from idling state to accelerating state can smoothly take place.

When the engine speed Ne abruptly decreases e.g. along the one-dot chain line b in (A) of FIG. 2, the decrease rate ΔNe of the engine speed detected when the first predetermined value NSA1 (at time t2 in FIG. 2) is traversed is compared with the predetermined value ΔNSA. When the decrease rate ΔNe is larger than the predetermined value ΔNSA, the engine is determined to be in abrupt deceleration state, and then the valve opening duty ratio DOUT of the control valve 6 is set to and held at a predetermined value DSA (100%) over a period of time TSA which is the sum of a time period TSAM determined by the predetermined value NSA1 and the decrease rate ΔNe and another time period TSAE determined by load applied by the electrical devices 15 (TSA=TSAM+TSAE), and a quantity of supplementary air corresponding to the set predetermined valve opening duty ratio DSA is supplied to the engine 1 (for time period TSA starting from time t2' in FIG. 2). The air shot control is effected in the same manner as described above also when the engine speed traverses the predetermined value NSA2 smaller than the predetermined value NSA1 and the other predetermined value NSA3 further smaller than NSA2 (at times t3 and t6 in FIG. 2). When the engine speed traverses the predetermined values NSA2, NSA3, if the shot air control has been already started, the already effected shot air control is continued. The dashed line c in FIG. 2 shows a change in the engine speed whose decrease rate ΔNe has such a small value that the shot air control is not required, when the first predetermined value NSA1 is traversed (at time t4 in FIG. 2), followed by an abrupt drop in the engine speed between the first predetermined value NSA1 and the second predetermined value NSA2, which is caused by newly added load on the electrical devices 15, for instance). In this case, when the engine speed drops across the second predetermined value NSA2 (at time t7 in FIG. 2), the shot air control is executed (for a time period from t'7 to TSA in (B) of FIG. 2). If the predetermined time period TSA, determined with respect to the predetermined value NSA2, has not elapsed even when the engine speed Ne drops below the upper limit NH as a feedback control starting speed value (at time t8), the aforementioned quantity of supplementary air supply (DOUT =DSA) is continually effected, with priority to the feedback control. When the predetermined time period TSA has elapsed (at time t'10), the feedback control is started with the valve opening duty ratio DXREF+DE set as the initial value. As described above, even though the engine speed Ne abruptly drops at any time in the course of deceleration, it can be smoothly and exactly brought to the desired idling speed by the shot air control effected with a plurality of predetermined speed values.

Figure 3:
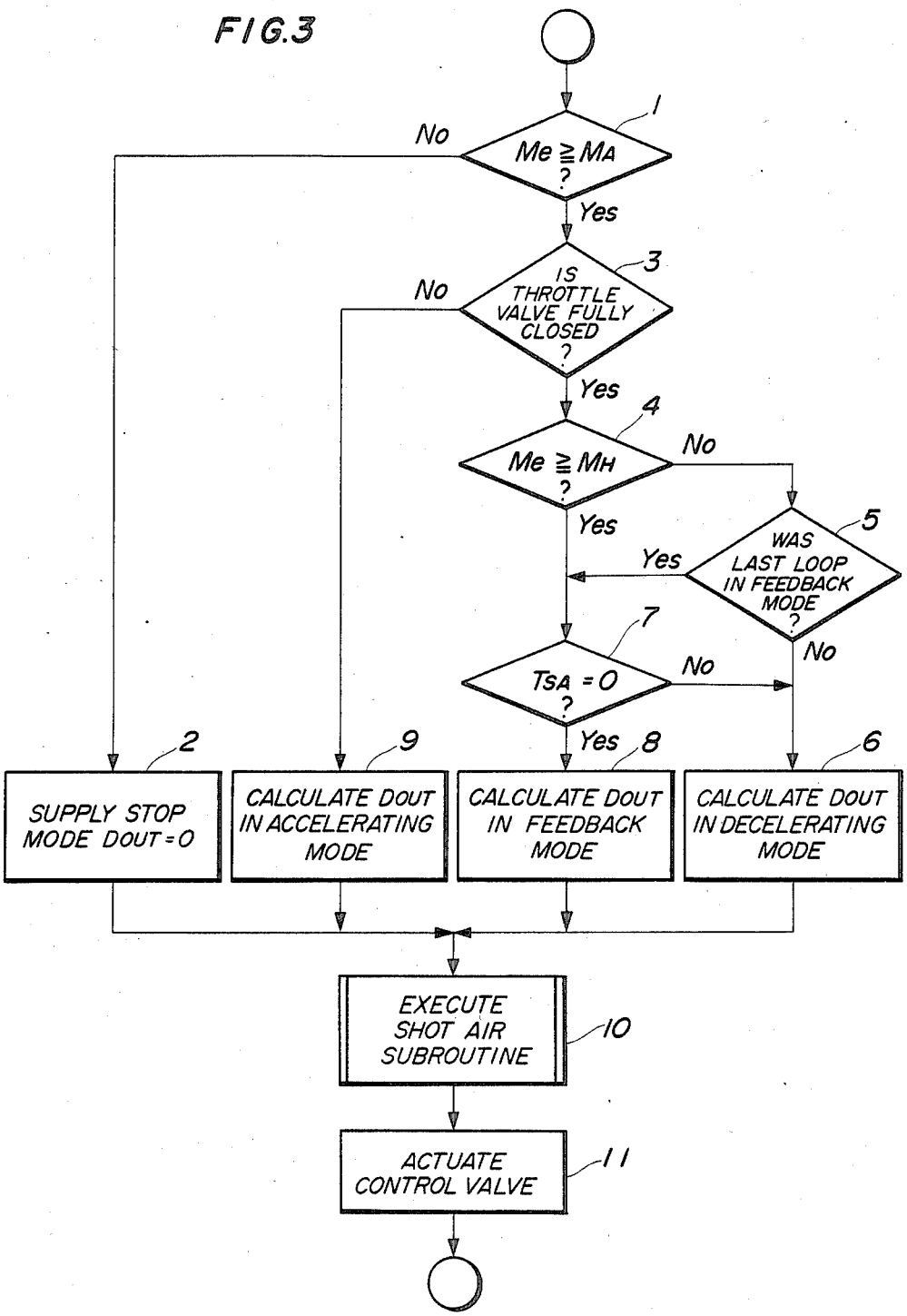
FIG. 3 is a flow chart showing a routine for executing the calculation of the valve opening duty ratio.

FIG. 3 is a flow chart showing a routine for calculation of the valve opening duty ratio DOUT, which is executed by the CPU 9*b* in the ECU 9 upon inputting of each TDC signal pulse from the Ne sensor 15.

At step 1, a determination is made as to whether or not a value Me representative of the time interval between a present TDC signal pulse and an immediately preceding TDC signal pulse, which is proportional to the reciprocal of the engine speed Ne is larger than a value MA corresponding to the reciprocal of predetermined rpm (e.g. 1500 rpm). If the answer to the determination at step 1 is negative (Me≧MA does not stand), that is, the engine speed Ne is larger than the predetermined value NA, not requiring supply of supplementary air to the engine, whereby the valve opening duty ratio DOUT of the control valve 6 is set to 0 at step 2 (hereinafter called "the supply stop mode").

If the answer to the determination at step 1 is affirmative or yes (Me≧MA stands), that is, if the engine speed is smaller than the predetermined value NA (after a time t1 in FIG. 2), it is determined whether or not the throttle valve 5 is substantially closed at step 3. If the throttle valve 5 is substantially closed, it is determined whether or not the value Me proportional to the reciprocal of the engine rpm Ne is larger than a value corresponding to the reciprocal of the upper limit NH of the desired idling rpm at step 4. If the answer is negative or no, that is, if the engine speed is larger than the upper limit NH of the desired idling speed, the program proceeds to the step 5. At step 5, a determination is made as to whether or not the preceding control loop was effected in feedback mode. The answer to the question at step 5 is affirmative or yes only when the engine speed has risen above the upper limit NH of the desired idling speed at engine idle, due to an external disturbance or a change in the electrical load, as hereinafter described. Therefore, when the engine is decelerating with the throttle valve 5 fully closed and at the same time the determination at step 4 is negative or no (a time period between times t1 and t13 on the solid line a, a time period between times t1 and t8 on the one-dot chain line b, or a time period between times t1 and t11 on the dashed line c in FIG. 2), the program proceeds to the step 6 to calculate the valve opening duty ratio DOUT in decelerating mode.

The valve opening duty ratio DOUT in deceleration mode is calculated by the use of the following equation (1):

$$DOUT = DXREF \times DE, \quad (1)$$

where DXREF represents a mean value of valve opening duty ratio DOUT which is determined in feedback control mode when all the electrical devices 15 in FIG. 1 remain off. The value DXREF is also used as a basic value to set an initial value applied at the start of control in feedback mode. DE represents a correction value set in response to load conditions of the electrical devices 15, i.e. an electrical load term. Employment of the electrical load term can cope with increased influence of the load of the electrical device 15 upon the engine speed when the engine speed is below NA, whereas the influence is comparatively small when the engine speed is above NA.

To this end, a value DEX is read from a valve opening duty ratio DEX-generating condition signal E table stored in the storage means 9*c* in the ECU 9, in response to the output signal from the generating condition sensor 19 in FIG. 1. To be more specific, a valve opening duty ratio value DEX is read from the valve opening duty ratio DEX-generating condition signal E table at a reference engine speed value (e.g. 700 rpm) shown in FIG. 5 in response to the generating condition signal E. In FIG. 5, as generating condition signal, there are provided predetermined values E1 (e.g. 1 V), E2 (e.g. 2 V), E3 (e.g. 3 V) and E4 (e.g. 4.5 V), while there are provided, as the basic correction value, predetermined valve opening duty ratio values DE1 (e.g. 50%), DE2 (e.g. 30%), DE3 (e.g. 10%) and DE4 (e.g. 0%), respectively, corresponding to the above predetermined voltage values.

When the generating condition signal E shows a value falling between adjacent predetermined values, a valve opening duty ratio value DEX is obtained by an interpolation calculation.

By substituting the DEX value thus read as corresponding to the reference engine speed value, into the following equation (2), an electrical load term DEn corresponding to the engine speed is calculated.

$$DEn = KE \times DEX \quad (2)$$

where KE represents a correction coefficient which is calculated based upon the difference between a value Mec corresponding to the reciprocal of the reference engine rpm (700 rpm) and the value Me, by the following equation (3).

$$KE = \eta \times (Mec - Me) + 1 \quad (3)$$

where $\eta$ represents a constant (e.g. $8 \times 10^{-4}$). The reason for setting the electrical load term DEm as a function of the signal E representative of generating conditions corresponding to field winding current in the generator and the engine speed Ne is that the load applied on the engine during operating the generator has a magnitude proportional to the generated electricity amount which is given as a function of the field winding current and the engine rpm, i.e. the rotor rpm of the generator.

Employment of the mean value DXREF of the valve opening duty ratio in feedback control mode as the basic value applied at the start of the feedback control mode can cope with fluctuations in quantity of supplementary air actually supplied to the engine due to variations in the operating characteristics of the control valve 6, by aging changes attributable to deterioration in the performance of the control valve 6, and clogging of the air filter 7.

When the answer at step 4 is yes ($Me \geqq MH$), that is, if the engine speed Ne is below the predetermined upper limit NH of the desired idling speed (at time t13 on the solid line a, at time t8 on the one-dot chain line b, or at time t11 on the dashed line c in FIG. 2), the program proceeds to the step 7 to determine whether or not the predetermined time period TSA in FIG. 2 has elapsed, that is, a counting value TSA of a timer set by the shot air subroutine, hereinafter referred to, is zero. When the answer is affirmative or yes, the program proceeds to the step 8 to calculate the valve opening duty ratio DOUT in feedback mode, whereas, if the answer is no (between times t11 and t'1 on the dashed line c in FIG. 2), the program proceeds to the step 6.

The valve opening duty ratio DOUT is calculated in feedback mode at step 8 by the following equation (4):

$$DOUT = DAIn + DP \quad (4)$$

where DAIn represents an integral control term, and DP a proportional control term. The integral control term value DAIn applied in the present loop is set to the sum of the immediately preceding value DAIn−1 of the integral control term stored in the storage means 9c in ECU 9 in FIG. 1, a correction value ΔDI determined in response to the difference between the actual engine speed and the desired idling speed, and a correction value DE commensurate with load applied by the electrical devices 15 ($DAIn = DAIn - 1 + \Delta DI + DE$). When the step 8 is executed for the first time, the initial value of the immediately preceding integral control term value DAI−1 is set to a value of valve opening duty ratio (DXREF+DE) determined at step 6. The proportional control term value Dp is set to a value corresponding to the difference between the actual engine speed and the desired idling speed.

During idling speed feedback mode control, the engine speed Ne can temporarily exceed the upper limit NH of the desired idling speed due to external disturbances or extinction of electrical load. However, once the feedback mode control starts, the same feedback control is continued so long as the throttle valve 5 is fully closed, so that engine stall will never occur. In addition, the feedback mode control can perform the engine speed control more promptly and exactly than the deceleration mode control. Therefore, according to the invention, when the engine speed Ne temporarily exceeds the upper limit NH of the desired idling speed by external disturbances or extinction of electrical load so that at step 4 $Me \geqq MH$ does not stand, step 5 is executed to determine whether or not the preceding loop was effected in feedback mode. On this occasion, the answer to step 5 should be affirmative or yes, and therefore the execution proceeds to the steps 7 and 8. Accordingly the control is continually effected in feedback manner.

When the throttle valve 5 is opened during idling speed feedback control (at time t14 in FIG. 2), the answer to the question of the step 3 is negative or no, and then the program proceeds to the step 9 wherein the valve opening duty ratio DOUT is calculated in accelerating mode. This control in accelerating mode is effected in order to prevent that the supply of supplementary air from the control valve 6 is suddenly stopped when a transition occurs in the engine operation from idling operation to accelerating operation with the throttle valve opened. The valve opening duty ratio DOUT applied to the accelerating mode control is obtained by subtracting a predetermined value ΔDACC from an immediately preceding value of the valve opening duty ratio at every generation of TDC signal pulse, where the initial value is set to an integral control term value DAIn−1 set in feedback mode control immediately before the throttle valve 5 is opened. This subtraction is continued until the valve opening duty ratio is zero.

Figure 4:
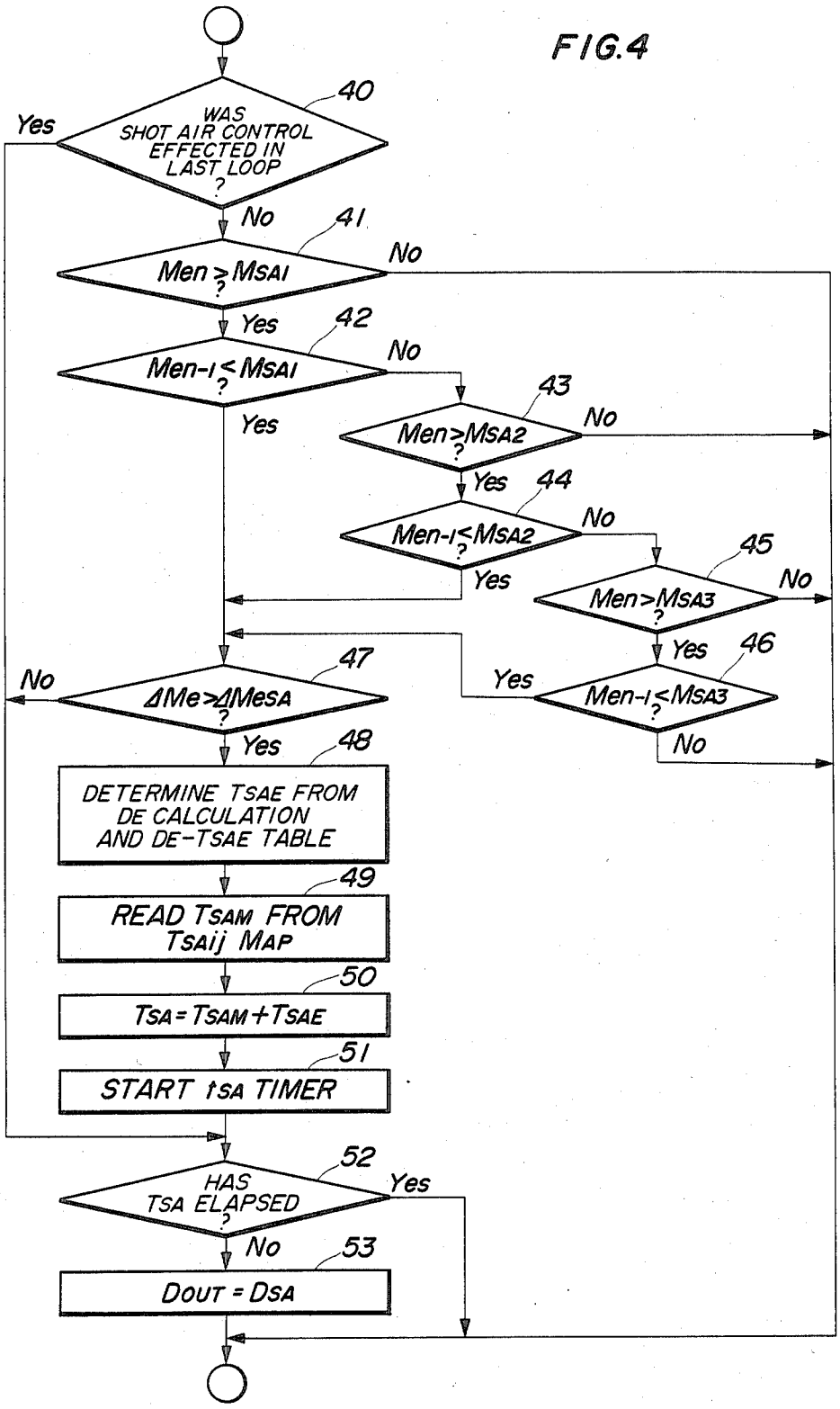
FIG. 4 is a flow chart showing a shot air subroutine according to the invention.

After the valve opening duty ratio DOUT is calculated at one of the aforementioned steps 2, 6, 8, and 9, the program proceeds to the step 10 for executing the shot air subroutine according to the present invention, shown in FIG. 4.

Referring to FIG. 4, first, a determination is made as to whether or not shot air control was executed at the time of generation of the immediately preceding pulse of TDC signal at step 40. If the answer of the question at the step 40 is negative or no, it is determined from step 41 to step 46 whether or not the engine speed Ne drops across either of the predetermined values NSA1, NSA2, or NSA3 during the time interval between generation of the immediately preceding pulse of TDC signal and generation of the present pulse of the same signal. That is, it is determined at step 41 whether or not a value Men proportional to the reciprocal of the engine rpm at generation of the present pulse of TDC signal is larger than a value MSA1 corresponding to the reciprocal of the first predetermined rpm NSA1 (e.g. 1100 rpm), and then at step 42 a value Men−1 corresponding to the reciprocal of the engine rpm Ne at the time of generation of the present pulse of TDC signal is smaller than the aforementioned value MSA1 ($Nen-1 > NSA1$). If the answer to the question at step 41 is negative or no ($Ne > NSA1$), the present sub program is terminated. If the determination at both of the steps 41 and 42 is affirmative or yes, it means that the engine speed has dropped across the first predetermined value NSA1 during the time interval between generation of the immediately preceding pulse and the present pulse of TDC signal. Then, the program proceeds to the step 47.

If the value Me is larger than the value MSA1 both at the time of generation of the preceding pulse and the present pulse of TDC signal, that is, if the engine rpm Ne is smaller than the value NSA1, it is determined whether or not the engine speed Ne has dropped across the second predetermined value NSA2 at steps 43 and 44 in the same manner as at steps 41 and 42. That is, if a value Men at the time of generation of the present pulse of TDC signal is larger than the value MSA2 proportional to the reciprocal of the second predetermined value NSA2 (e.g. 1000 rpm), which means Men>Msa2 does not stand at step 43, the present sub program is terminated. When both Men>MSA2 and Men−1<MSA2 stand (the determination result at step 44 is affirmative), the program proceeds to the step 47.

In the same manner as above, when the value Men both at the time of generation of immediately preceding pulse and at the time of generation of the present pulse of TDC signal is larger than the predetermined value MSA2, that is, if the engine rpm Ne is smaller than the second predetermined value NSA2, a determination is made as to whether or not the engine speed has dropped across the third predetermined value NSA3 at steps 45 and 46 as was made at steps 43 and 44. To be specific, if the value Men at the time of generation of the present pulse of TDC signal is larger than a value MSA3 corresponding to the reciprocal of the third predetermined value NSA3 (e.g. 800 rpm), that is, if Men>MSA3 does not stand at step 45, the sub program is terminated. When both Men>MSA3 and Men−1<MSA3 stand (the determination at step 46 is affirmative), the sub program proceeds to the step 47.

At the step 47, a decrease rate ΔMe (=Men−-Men−4) of the engine speed is calculated from a Men value detected at the time of generation of the present pulse of TDC signal and a value Men−4 detected at the time of generation of a preceding pulse of TDC signal corresponding to the same cylinder that corresponds to the present pulse (the detected value Men−4 is stored in the storage means 9*c* in ECU 9), and then it is determined whether or not the value ΔMe is larger than a predetermined value ΔMeSA corresponding to the reciprocal of the predetermined value ΔNSA. By thus using the value Men−4 detected at the time of generation of a fourth TDC signal pulse before the present one, it is possible to determine the decrease rate ΔMe with accuracy irrespective of fabricating error and mounting error of the Ne sensor 14. If these errors are respective allowable ranges, the immediately preceding value Men−1 may be used instead of the value Men−4. If the determination at step 47 is affirmative or yes, that is, the decrease rate ΔMe of the engine speed is larger than the predetermined value ΔMeSA, it is determined that the engine is in abrupt deceleration state. Then, the sub program proceeds to the step 48 wherein the electrical load term value DE is calculated and a value of the time period TSAE for shot air control corresponding to the calculated electrical load term value DE, i.e. operating conditions of the electrical devices 15, is obtained from a DE-TSE table.

FIG. 6 shows the DE-TSAE table wherein the value TSAE is set so as to increase as the value DE increases. Referring again to FIG. 4, a value of the time period TSAM is read from a MSA-Me map in FIG. 7, which corresponds to the predetermined value MSA and the value ΔMe, at step 49. In the MSA-ΔMe map shown in FIG. 7, four predetermined values ΔMe1-ΔMe3 are provided, corresponding, respectively, to the predetermined value MSA1, MSA2, and MSA3, ΔMe0 corresponding to the engine rpm difference ΔNe of 40 rpm/TDC, for instance —Me3 corrsponding to the difference ΔNe of 200 rpm/TDC ,for instance. The value TSA i,j is so set that it becomes smaller as the numeral i becomes larger and j smaller. At step 50, te setting time period TSA for the shot air timer tSA is calculated by the use of the values TSAE and TSAM obtained at steps 48 and 49, according to the following equation (5).

$$TSA = TSAM + TSAE \quad (5)$$

Then, at step 51, the shot air timer tSA is operated over the set period TSA, and then the program proceeds to the step 52. At step 52, it is determined whether or not the set time period TSA on the timer tSA has elapsed. If the determination result is negative or no, the program proceeds to the step 53 wherein the valve opening duty ratio DOUT of the control valve 6 set at steps 6 and 8 in FIG. 3 is replaced by the predetermined value DSA (100%), followed by termination of the program. Here, the shot air control is effected (at time t'2 in FIG. 2) by opening the control valve 6 with the valve opening duty ratio DOUT determined as described above, at step 11 in FIG. 3.

In the next loop, the answer to the question at step 40 in FIG. 4 should be affirmative or yes, and then, the program jumps to the step 52 to determine whether or not the set time period TSA has elapsed. If the answer is negative or no, that is, if the set time period TSA has not elapsed, the step 53 is repeated, wherein the valve opening duty ratio DOUT is set to the predetermined value DSA. Eventually the shot air control is effected over the set time period TSA.

If it is determined at step 52 that the set time period TSA on the timer tSA has elapsed, the program skips the step 53 and then is terminated. To be more specific, the control valve 6 is opened at step 11 in FIG. 3, with the valve opening duty ratio DOUT set at step 2, 6, 8, or 9.

When the value ΔMe is determined to be smaller than the predetermined value ΔMeSA at step 47 in FIG. 4, the program proceeds to the step 52 because the engine is then in slow deceleration state. On such an occasion, the timer tSA is determined to be inoperative at step 51, so that the determination result at step 52 is affirmative or yes. Then the program skips the step 53 and is terminated. Thus, the valve opening duty ratio DOUT is not replaced by the predetermined value DSA.

What is claimed is:

1. An intake air quantity control method at deceleration for an internal combustion engine having an intake passage, a throttle valve arranged in said intake passage, a supplementary air passage bypassing said throttle valve in said intake passage, a control valve arranged in said supplementary air passage for controlling a quantity of supplementary air to be supplied to said engine, and at least one electrical device driven by said engine, wherein rotational speed of said engine is detected and the quantity of supplementary air is controlled to a desired value when the engine is decelerated such that the detected engine rotational speed approaches a desired idling speed, the method comprising the steps of:

(a) setting a plurality of predetermined engine speed values higher than said desired idling speed value;

(b) detecting a magnitude of load applied on said engine by said electrical device, when said engine is decelerating toward said desired idling speed value;

(c) determining which of said plurality of predetermined engine speed values the engine speed has dropped across, when said engine is decelerating toward said desired idling speed value;

(d) detecting a decrease rate of the engine speed at one of said predetermined engine speed values across which said engine speed is determined to have dropped;

(e) determining a quantity of supplementary air supplied from said control valve corresponding to said one of said predetermined engine speed values determined at step (c) and said decrease rate detected at step (d);

(f) correcting said quantity of supplementary air determined at step (e) in dependence on the magnitude of load of said electrical device detected at step (b); and (g) driving said control valve to open based upon said quantity of supplementary air determined at step (e).

2. A method as claimed in claim 1, wherein said engine includes a generator device driven by said engine for supplying electric power to said electrical device, the magnitude of load applied by said electrical device on said engine being detected based upon the detected engine speed and a value of a parameter indicative of generating conditions of said generator device.

3. An intake air quantity control method at deceleration for an internal combustion engine having an intake passage, a throttle valve arranged in said intake passage, a supplementary air passage bypassing said throttle valve in said intake passage, and a control valve arranged in said supplementary air passage for controlling a quantity of supplementary air to be supplied to said engine, wherein the rotational speed of said engine is detected and the quantity of supplementary air is controlled to a desired value when the engine is decelerated such that the detected engine rotational speed approaches a desired idling speed, the method comprising the steps of:

(a) setting a plurality of predetermined engine speed values higher than said desired idling speed value;

(b) determining which of said plurality of predetermined engine speed values the engine speed has dropped across, when said engine is decelerating toward said desired idling speed value;

(c) detecting a decrease rate of the engine speed at one of said predetermined engine speed values across which the engine speed is determined to have dropped;

(d) determining a quantity of supplementary air supplied from said control valve corresponding to said one of said predetermined engine speed values determined at step (b) and said decrease rate detected at step (c); and (e) driving said control valve to open based upon said quantity of supplementary air determined at step (d).

4. A method as claimed in claim 3, wherein the quantity of supplementary air supplied from said control valve is set to a smaller value as said one of the predetermined engine speed values detected at step (c) is closer to said desired idling speed value.

5. A method as claimed in claim 3, wherein the quantity of supplementary air supplied from said control valve is set to a larger value as the decrease rate of the engine speed detected at step (d) is larger.

6. A method as claimed in any of claims 3 to 5, wherein said control valve is opened only when the decrease rate of the engine speed detected at step (d) is larger than a predetermined value.

* * * * *